United States Patent [19]

Cunningham et al.

[11] 4,230,284

[45] Oct. 28, 1980

[54] METHOD AND APPARATUS FOR COLLECTING STRANDS

[75] Inventors: Cecil R. Cunningham, Anderson; Ray M. Fulmer; Gordon E. Cherry, both of Aiken, all of S.C.

[73] Assignee: Owens-Corning Fiberglas Corporation, Toledo, Ohio

[21] Appl. No.: 56,653

[22] Filed: Jul. 11, 1979

[51] Int. Cl.[3] ..... B65H 54/02; B65H 67/04

[52] U.S. Cl. ..... 242/18 G; 65/11 W; 242/18 A; 242/18 PW

[58] Field of Search ..... 242/18 G, 18 A, 18 PW, 242/18 R, 25 A; 65/11 W

[56] References Cited

U.S. PATENT DOCUMENTS 4,040,572 8/1977 Melan et al. ..... 242/18 G X

*Primary Examiner*—Stanley N. Gilreath

*Attorney, Agent, or Firm*—Ronald C. Hudgens; Philip R. Cloutier; Greg Dziegielewski

[57] ABSTRACT

Method and apparatus are provided for the initiation of attenuation and collection of a strand by an operator remote from the winder wherein an interim advancement means, a movable member adapted to move the strand from a first zone spaced from a collet to a second zone adjacent the interim advancement means, means for directing the strand into the interim advancement means and an actuator means for moving said strand advancing along the collet into contact with the strand engagement section of the collet cooperate to initiate collection of the strand upon the collet.

16 Claims, 8 Drawing Figures

METHOD AND APPARATUS FOR COLLECTING STRANDS

TECHNICAL FIELD

The invention disclosed herein relates to the production of continuous textile strands incorporating process and apparatus for the semi-automatic start up of such production.

BACKGROUND ART

As is known in the art, the production of continuous glass filaments is effected in a two level operation. The first, or forming room, level generally contains the fiber-forming feeder and size applicating systems, and the second, or lower level, generally contains the winder and other associated equipment.

Historically, to initiate fiber attenuation and collection, the system has demanded cooperation between an operator on the forming room level and another operator on the winder level. The method and apparatus disclosed herein provides a system wherein the operator on the forming room level, without help from an operator on the winder level, can initiate the attentuation and collection of such strands.

DISCLOSURE OF INVENTION

Method and apparatus are provided for producing wound packages of strand comprising: a feeder adapted to supply streams of heat softened inorganic material, said feeder being located on a first level of a structure, a winder adapted to attenuate said streams into filaments having a driven rotatable collet having a package collection region and a temporary collection region associated with a strand engaging section, said winder being located on a second level of said structure, means for gathering said filaments into a strand, an interim advancement means for advancing said strand when said strand is not being collected on said collet, said interim advancement means being spaced from said collet, said interim advancement means and said collet being oriented such that said strand is advanced along a path immediately adjacent said strand engaging section when said strand is advanced by said interim means from said gathering means; a movable member positioned intermediate said collet and said interim advancement means, said member being adapted to move said strand from a first zone spaced from said collet and said interim advancement means to a second zone to effect advancement of said strand by said interim advancement means, guide means located adjacent said winder to direct said strand into the first zone, actuator means for moving said strand advancing along said path into said strand engaging section to initiate collection of said strand on said collet, and control means located in said first level of said structure to energize said movable member and said actuator means to effect initiation of advancement of the strand by said interim collection means and subsequent initiation of collection of said strand on said collet by an operator located on said first level in the absence of assistance from another operator located on said second level.

BEST MODE OF CARRYING OUT INVENTION

Figures 1, 2, 3:
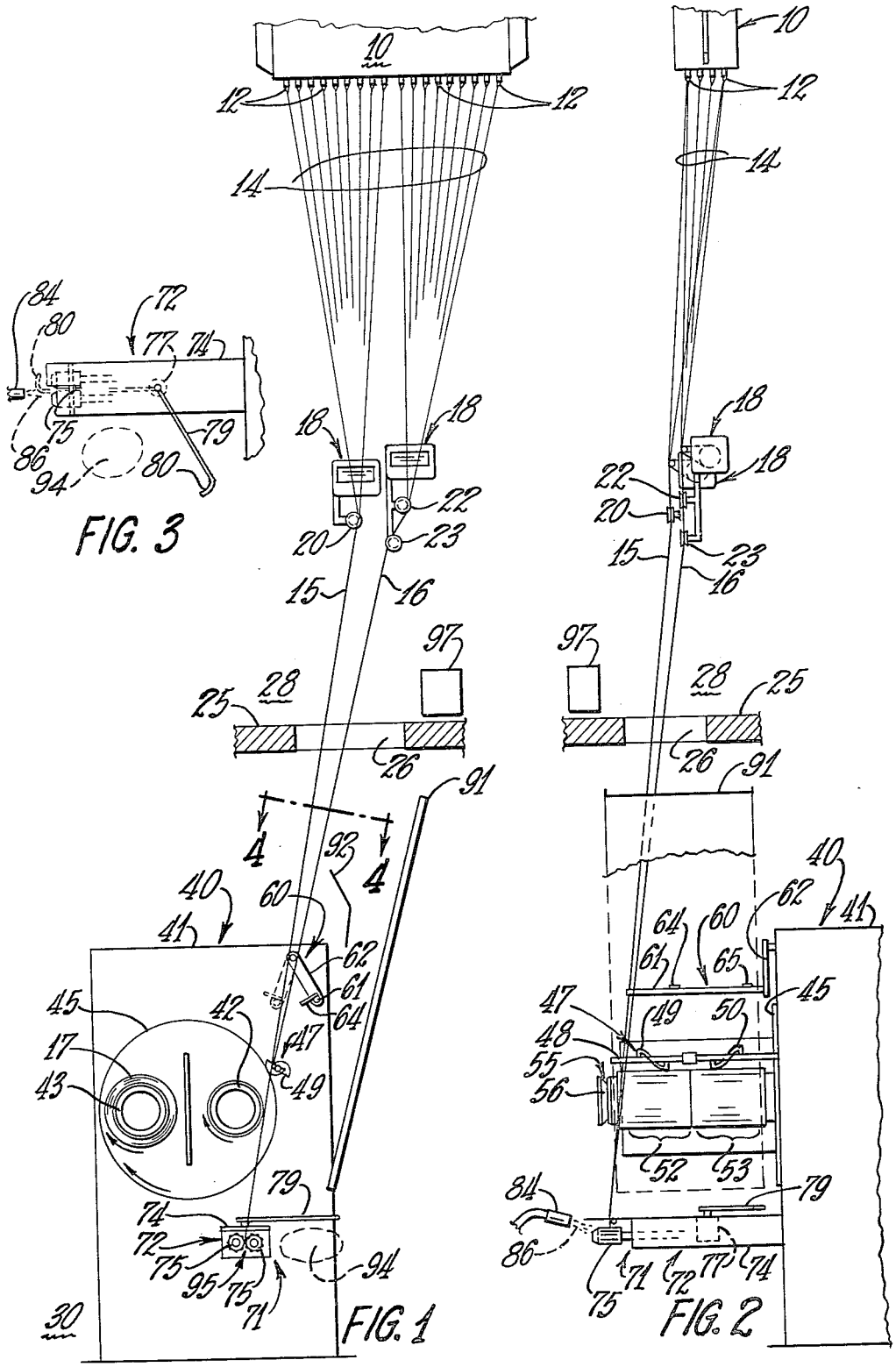
FIG. 1 is a semi-schematic front elevational view of a fiberforming operation according to the principles of this invention.
FIG. 2 is a side elevational view of the system as shown in FIG. 1.
FIG. 3 is a plan view of one of the components shown in FIGS. 1 and 2.

As shown in FIGS. 1 and 2, feeder 10 supplies a plurality of streams of molten inorganic mineral material, such as glass, which are attenuated into filaments 14 by means of winder 40. Intermediate feeder 10 and winder 40, size applicator 18 applies a suitable liquid sizing or coating material as is known in the art. Subsequently, filaments 14 are divided into strands 15 and 16 at gathering shoes 20 and a pair of gathering shoes 22 and 23, respectively.

Strands 15 and 16 then advance through opening 26 in floor 25 which separates first level 28 and second level 30 of the structure where strands 15 and 16 are wound into packages 17 on winder 40.

Generally, a forming room operator occupies the first level 28 where he tends to the feeder and size applicators, and another operator located on the second level 30 tends to the winder 40.

Winder assembly 40 is comprised of driven rotatable collets 42 and 43 which are rotatably mounted on turret 45 which is rotatably mounted in housing 41. Such turret type winders can be of any suitable type, for example, see U.S. Pat. Nos. 3,109,602 and 3,292,871.

Traversing assembly 47 of winder 40 is comprised of a shaft 48 and spiral wires 49 and 50 as is known in the art.

Each of the collets 42 and 43 has a plurality of package collection sections 52 and 53 and a temporary collection region 55 having a strand engagement section 56 associated therewith. Collets 42 and 43 having package collection sections 52 and 53 and temporary collection region 55 having an associated strand engagement section 56 can be of the type disclosed in U.S. Pat. No. 4,069,984, No. 4,046,329, and No. 4,054,249 issued to Klink and Eisenberg which are hereby incorporated by reference.

In general, strand engagement section 56 consists of a groove having a pin projecting therefrom to entrap strands 15 and 16 when the strands are brought into the strand engagement section 56 as the collet is rotating. In another embodiment, rubber bands may be wrapped in the base of the groove as an alternative or in combination with the pin.

Positioned intermediate the traversing assembly 47 and the gathering shoes 20, 22, and 23, actuator means 60, which can be attached to winder 40, is comprised of shaft 61 which is attached at one end to carriage 62 which is rotatable and linearly movable to advance shaft 61 in a direction along its length and rotate about an axis substantially parallel to shaft 61 but spaced therefrom, as is known in the art.

Projections 64 and 65 extend laterally outward from shaft 61 to engage strands 15 and 16 as will be described later herein.

As shown in FIG. 3, threading device 71, which can be attached to housing 41, is comprised of an interim advancement means 72, movable member 79 and a nozzle means 84.

Housing 74 of threading device 71 securely contains interim advancement means 72 which is comprised of a pair of meshed rolls 75 adapted to advance strand therebetween at predetermined times. Such interim advancement means can be of the type disclosed in U.S. Pat. No. 3,539,317 and No. 4,050,639 which are hereby incorporated by reference.

Movable member or bar 79 is attached at one end to motive means 77 such as a rotary pneumatic cylinder. Distal end 80 of movable member 79 is a forwardly disposed J-shaped configuration which is employed to move strands 15 and 16 from first zone 94 to second zone 95 as will be explained later herein.

Nozzle means 84 is positioned opposite rolls 75 to direct a stream of fluid, such as water, inwardly between rolls 75 such that strands 15 and 16 by positioned in second zone 95, which is located immediately in front of and adjacent to rolls 75, are fluidically forced in between driven rotatable rolls 75 and advanced thereby.

Plate or guide means 91 extends approximatelyfrom a point adjacent opening 26 and floor 25 to a point adjacent first zone 94. The lower edge of guide means 91 is laterally displaced from threading device 71 such that strands 15 and 16 can be hand fed by the forming operator on the first level down guide means 91 into first zone 94. Guard 92 located intermediate the apparatus of winder assembly 40 and guide means 91 is positioned to assist the operator in directing strands 15 and 16 along guide means 91.

As will be explained later, control means 97, which can be of the foot operated solenoid type readily known in the art, is positioned to allow the operator on the first level to control the movements of threading device 71 from the forming room area to initiate the attenuation and advancement of strands 15 and 16 by winder assembly 40 in the absence of assistance from an operator located on the second level.

As set forth above and as shown in FIGS. 1 through 7, the threading device 71, when employed with a winder adapted to wind a plurality of packages on each collet, is used in conjunction with an actuator means 60 which is spaced from collets 42 and 43 and from threading device 71. And as shown in FIGS. 1 through 7, actuator device 60 is a modified hold-off means which, as is known in the art, operates during automatic transfer of the winding operation from one collet to the next.

During operation, upon start up or after a break out, the forming room operator on the first level 28 manually pulls filaments 14 over size applicators 18 and separates the filaments into two groups of strands 15 and 16 at gathering shoes 20, 22 and 23, respectively. A tandem pair of gathering shoes 22 and 23 are employed to more positively retain strand 16 within the gathering shoes as the operator manually advances strands 15 and 16 through opening 26 to first zone 94 in the second level 30.

Once the operator has dropped strands 15 and 16 down guide means 91 to first zone 94, the operator depresses control means or foot switch 97 to activate member 79 to move through a partial arc such that strands 15 and 16 are moved or swept into second zone 95 located immediately in front of rolls 75. When control means 97 is depressed, nozzle means 84 is also activated to supply a stream of fluid 86 (from a source not shown) such that strands 15 and 16 are fluidically forced into and between rolls 75 such that strands 15 and 16 are advanced thereby.

The interim advancement means 72 and the collet in the package build position (collet 42 as shown in FIG. 1) are oriented such that the strands are advanced along a path immediately adjacent the strand engaging section 56 of collet 42. As such, the strands may or may not be in contact with collet 42, but in any event are not being advanced by means of collet 42, even though collet 42 may be rotating.

Actuator means 60 may also be activated by control means 97 to extend shaft 61 such that the strands do not improperly engage various components of the winder such as traversing assembly 47 as the forming room operator manually controls strands 15 and 16 so they engage the interim advancement means.

Once the operator is satisfied that the strands are properly positioned and being advanced by interim means 72, the operator depresses an automatic start switch (not shown) located on the first level to activate actuator means 60 to place actuator in the automatic start-up mode to initiate the advancement of strands 15 and 16 upon collet 42 and the subsequent initiation of package build for both packages.

FIGS. 4, 5, 6 and 7 schematically depict the orientation of strands 15 and 16 with respect to collet 42, traversing assembly 47 and actuator means 60 during the auto-start-up mode.

Figure 4:
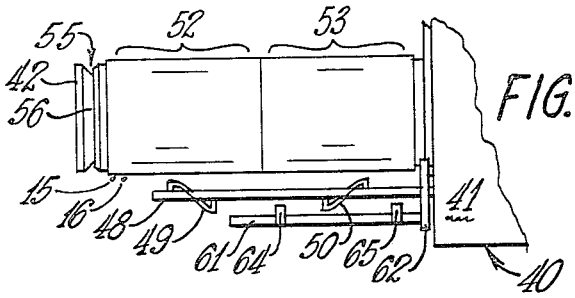
FIG. 4 is a sectional view along view 4—4 of FIG. 1 of certain components of the system at a first point in time.

FIG. 4 depicts a point in time wherein strands 15 and 16 are being advanced by interim advancement means 72. Interim advancement means 72, collet 42, gathering means 20, 22 and 23 are oriented such that strands 15 and 16 are advanced along paths immediately adjacent strand engagement section 56.

Figure 5:
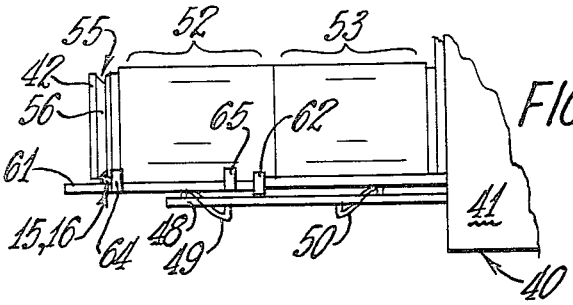
FIG. 5 is similar to FIG. 4 depicting the same components in a different relationship at a different point in time.

FIG. 5 depicts the system at a point in time subsequent to that of FIG. 4 after the operator has activated the automatic start up mode switch causing actuator means 60 to activate such that shaft 61 moves linearly and arcuately outwardly such that first projection 64 forces or moves strands 15 and 16 into the strand engagement section 56 causing strands 15 and 16 to be wound upon temporary collection region 55 of collet 42.

Carriage 62 is attached to a cam guided pneumatic cylinder assembly, as is known in the art, to produce the rotational and lateral movement of shaft 61.

Figure 6:
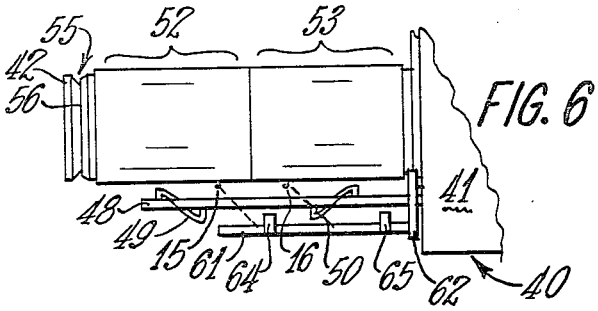
FIG. 6 is similar to FIGS. 4 and 5 depicting the relationship of some components at yet another point in time.

Once strands 15 and 16 have been moved into strand engagement section 56, the strands automatically cease to be advanced by interim advancement means 72, as is known in the art. The forward thrust of actuator means 60 is momentary to move strands 15 and 16 into section 56, and actuator means 60 is deactivated or retracts for a predetermined length of time to allow strands 15 and 16 to assume their natural spaced-apart orientation tangent to the circumference of the collet as shown in FIG. 6. The gathering shoes 20, 22 and 23 and collet 42 are oriented to provide the spaced-apart orientation of strands 15 and 16 when the strands are not influenced by the spiral wires and/or the actuator means 60.

Figure 7:
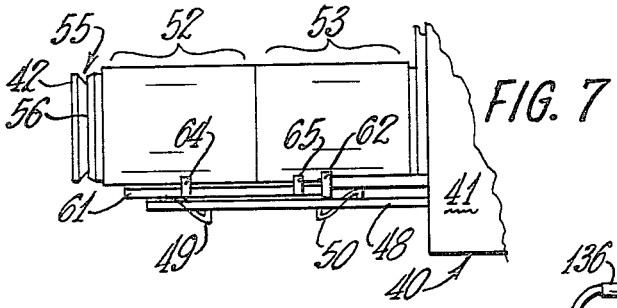
FIG. 7 is similar to FIGS. 4, 5 and 6 depicting such components in a different relationship at yet another point in time.

After a predetermined period of time, approximately 3 to 5 seconds, actuator means 60 is reactivated to laterally and rotatably thrust shaft 61 along collet 60 such that projection 64 engages only strand 15 and projection 65 engages only strand 16 moving strands 15 and 16 to the extreme forward position of package collection regions 52 and 53, respectively. Traversing assembly 47 is then positioned with respect to strands 15 and 16 such that as actuator means 60 is again deactivated, strands 15 and 16 properly engage spiral wires 49 and 50, respectively as shown in FIG. 7. Thus, the initiation of the desired package build can be initiated by the forming room operator in the absence of assistance from the winding room operator.

The electro-mechanical control system for controlling actuator means or hold off assembly 60 can be modified by the addition of a pair of timers and associated contacts, switches and relays to effect the first activation of the actuator means 60 to force strands 15 and 16 into the strand engagement section upon the first forward thrust, retract actuator 60 for a predetermined period of time, and then be reactivated to effect another forward thrust to individually position the plurality of strands with respect to the associated spiral wire and package collection region, and subsequently withdraw actuator 60 to permit the desired package build. By suitable conventional contacts, relays, and the like, the control system for activating the actuator means 60 is not energized during the fully automatic mode operation of the turret type winder. That is, the actuator means or hold off arm resumes normal function as a hold off means during the fully automatic mode of the winder for strand transfer from collet to collet with the double thrust being reserved only for automatic start-up.

Figure 8:
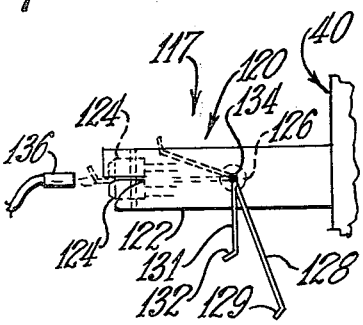
FIG. 8 shows another embodiment of one form of the invention disclosed herein.

Such semi-automatic start up of a fiber-forming operation and package collection can be much more easily initiated when only a single strand is being wound into a single package. Assuming a similar orientation with respect to the collet and gathering shoe or shoes, threading device 117 as shown in FIG. 8 incorporates interim advancement means 120, movable member 128, nozzle means 136 and actuator means 131. Housing 122 which can be attached to winder 40 contains driven meshed rolls 124 adapted to advance the strand therebetween, as is known in the art.

When the strand has been manually advanced to first zone 94, which is spaced from the collet spiral wire and threading device, the operator activates motive means 126, such as a rotary air cylinder, by means of control means 97 located on the first or forming level. Motive means 126 can be fastened to housing 122.

Attached to the output end of motive means 126 is element 134 which is attached to one end of movable member 128. The distal end of movable member 128 is J- or cup-shaped to effect the transfer of movement of the strand from the first zone to the second zone immediately in front of rolls 124. Also attached to element 134 is actuator means 131 which can be another curved or bent rod having a forwardly biased end 132 similar to movable member 128.

As can be seen in FIG. 8, rod 131 is substantially shorter than member 128 and is arcuately displaced forwardly of member 128. To move the strand from the first zone, the motive means 126 is first activated to effect an arcuate sweep of member 128, as shown in FIG. 8, to engage and move the strand from the first zone to the second zone immediately in front of rolls 124. A stream of fluid from nozzle 136 forces the strand between rolls 124.

The operator then disengages or deactivates motive means 126 to return the member 128 and rod 131 to the position shown in solid lines in FIG. 8. At that time, the strand is being advanced by the interim advancement means 120 and is advancing along a path immediately adjacent strand engagement section 56 of the collet.

When the operator is ready to initiate the collection of the strand upon the collet, the operator merely reactivates motive means 126 causing rod 131, as well as member 128, to effect an arcuate sweep such that rod 131 displaces the strand being advanced at pull rolls 124 inwardly sufficient to force the strand into the strand engagement section of the collet. The forward positions of member 128 and rod 131 are shown in dashed lines in FIG. 8.

Thus, the strand is first brought into engagement with the pull rolls 124 by means of member 129 and nozzle 136. Rod 131 has a forwardly biased end 132 to permit the withdrawal of rod 131 without permanently displacing the strand from the staged position adjacent the strand engagement section of the collet. That is, the curved or forwardly biased end 132 merely "bumps" the strand slightly outwardly and does not substantially carry the strand back with the rod, which permits rod 131 to be retracted. Upon the subsequent activation of motive means 126, rod 131 then engages the strand being advanced by the pull rolls and laterally moves the strand into engagement with the strand engagement section to initiate collection of the strand upon the collet. Rod 131 must not extend into the first zone to effect proper strand transfer.

It is apparent that within the scope of the invention, modifications and different arrangements can be made other than as herein disclosed. The present disclosure is merely illustrative with the invention comprehending all variations thereof.

INDUSTRIAL APPLICABILITY

The invention described herein is readily applicable to the formation of continuous glass fibers.

We claim:

1. Apparatus for the initiation of collection of a strand comprising:

a rotatable collet having a package collection region and a temporary collection region associated with a strand engagement section;

a pair of rolls adapted to advance said strand when said strand is not being collected on said collet, said rolls being spaced from said collet, said rolls and said collet being oriented such that said strand is advanced along a path immediately adjacent said strand engagement section when said strand is advanced by said rolls;

a movable member adapted to move said strand from a first zone spaced from said collet and said rolls to a second zone adjacent said rolls;

nozzle means for directing a stream of fluid into said second zone to move said strand into contact with said rolls to initiate the advancement of said strand by said rolls; and actuator means for moving said strand advancing along said path into said strand engagement section to initiate collection of said strand upon said collet.

2. The apparatus of claim 1 wherein said actuator means is comprised of a movable shaft spaced from and independent of said collet, rolls, and member.

3. The apparatus of claim 1 wherein said actuator means and said member are rotatable about a common axis.

4. The apparatus of claim 3 wherein said actuator means and said member extend from a common element rotatable about said axis.

5. The apparatus of claim 1 wherein said movable member is joined to a rotary pneumatic cylinder attached to a common housing with said rolls.

6. Apparatus for producing and collecting filaments as a strand comprising:

a feeder adapted to supply streams of inorganic material, said feeder being located on a first level of a structure;

a winder adapted to attenuate said streams into filaments having a rotatable collet having a package collection region and a temporary collection region associated with a strand engagement section, said winder being located on a second level of said structure;

means for gathering said filaments into a strand;

an interim advancement means spaced from said collet for advancing said strand when said strand is not being collected on said collet, said interim advancement means and said collet being oriented such that said strand is advanced along a path immediately adjacent said strand engagement section when said strand is advanced by said interim means from said gathering means;

a movable member adapted to move said strand from a first zone spaced from said collet and said interim advancement means to a second zone to permit advancement of said strand by said interim advancement means;

actuator means for moving said strand advancing along said path into said strand engaging section to initiate collection of said strand on said collet; and control means located in said first level of said structure to energize said movable member and said actuator means to effect the initiation of advancement of the strand by said interim advancement means and subsequent initiation of collection of said strand on said collet by an operator located on said first level in the absence of assistance from another operator at said winder.

7. The apparatus of claim 6 wherein said interim advancement means is comprised of a pair of meshed rolls adapted to advance said strand therebetween; and wherein said apparatus further comprises a nozzle means for directing a stream of fluid into said second zone to move said strand into contact with said rolls to initiate advancement of said strand by said rolls.

8. The apparatus of claim 6 wherein said actuator means is comprised of a movable shaft spaced from and independent of said collet, rolls, and member.

9. The apparatus of claim 6 wherein said actuator means and said member are rotatable about a common axis.

10. The apparatus of claim 9 wherein said actuator means and said member extend from a common element rotatable about said axis.

11. Apparatus for the initiation of collection of a plurality of strands comprising:

feeder means adapted to supply streams of filament forming material;

a winder adapted to attenuate said streams into filaments, said winder having a collet having a plurality of package collection regions and a temporary collection region associated with a strand engagement section, said winder having a strand traversing assembly adapted to distribute each of said strands within the package collection region associated therewith;

means for gathering said filaments into a plurality of strands;

an interim advancement means spaced from said collet for advancing said strands when said strands are not being collected on said collet, said interim advancement means, said collet and said gathering means being oriented such that said strands are advanced along paths immediately adjacent said strand engagement section when said strands are being advanced by said interim means from said gathering means, said gathering means and said collet being oriented such that said strands assume a spaced-apart orientation with said strands occupying a position in at least one of the package collection regions associated therewith when said strands are initially collected on said collet;

a movable member adapted to move said strand from a first zone spaced from said collet and said interim advancement means to a second zone to effect advancement of said strand by said interim advancement means; and actuator means for moving said strands advancing along said paths into said strand engagement section to initiate collection of said strands on said collet, said actuator means being adapted to permit said strands to assume said spaced-apart orientation before moving each of said strands to engage the traversing assembly to initiate package collection at the package collection region associated therewith.

12. The apparatus of claim 11 wherein said actuator means is a movable shaft spaced from said collet and said interim advancement means, said shaft having a plurality projections extending therefrom oriented to contact said strands, one of said projections being positioned to move said strands advancing along said paths into the strand engagement section upon a first activation of said shaft, the shaft being adapted to engage said strands such that each of said strands contacts the projection associated therewith upon a subsequent activation to engage each of said strands with the traversing assembly associated therewith to effect package collection at the package collection region associated therewith.

13. The apparatus of claim 12 wherein said shaft is the hold off mechanism for a turret type winder.

14. The apparatus of claim 12 wherein said shaft is rotatable and laterally extensible; said shaft being laterally offset from the axis of rotation therefor.

15. The method of initiating the collection of a plurality of strands comprising:

providing a winder adapted to attenuate streams of material into filaments, said winder having a collet having a plurality of package collection regions and a temporary collection region associated with a strand engagement section, said winder having a strand traversing assembly adapted to distribute each of said strands within the package collection region associated therewith;

gathering said filaments into a plurality of strands at a gathering means;

providing an interim advancement means spaced from said collet adapted to advance said strands when said strands are not being collected on said collet, said interim advancement means, said collet and said gathering means being oriented such that said strands are advanced along paths immediately adjacent said strand engaging section when said strands are being advanced by said interim means from said gathering means, said gathering means and said collet being oriented such that said strands assume a spaced-apart orientation with said strands occupying a position in at least one of the package collection regions associated therewith when said strands are being collected on said collet;

positioning said strands in a first zone spaced from said collet and said interim collection means;

providing a movable member adapted to move said strand from a first zone spaced from said collet and said interim collection means to a second zone to effect advancement of said strand by said interim collection means;

moving said strands from said first zone into contact with said interim collection means to advance said strands by said interim means;

providing an actuator means adapted to move said strands at predetermined times;

activating said actuator means to move said strands being advanced by said interim means into contact with said strand engagement section;

deactivating said actuator means to permit each of said strands to form a spaced-apart array along the length of the collet;

reactivating said actuator means to position each of said strands to contact said traversing assembly to initiate the formation of a package at the package collection regions associated with said strands.

16. The method of claim 15 wherein said movable member and said actuator means are controlled from a position remote from said winder.

* * * * *